US005181895A

United States Patent [19]

Larson et al.

[11] Patent Number: 5,181,895

[45] Date of Patent: Jan. 26, 1993

[54] LEG EXERCISE APPARATUS AND METHOD

[75] Inventors: Randall Larson; Gloria A. Larson, both of Columbia, S.C.

[73] Assignee: Advanced Therapeutics, Inc., Columbia, S.C.

[21] Appl. No.: 810,286

[22] Filed: Dec. 19, 1991

[51] Int. Cl.[5] ..... A63B 21/06; A63B 23/10

[52] U.S. Cl. ..... 482/93; 482/148; 482/80

[58] Field of Search ..... 482/93, 121, 79, 111, 482/80, 148, 92, 98, 99, 100, 44, 50, 92, 94, 97; 128/25 B, 25 R; 482/100–103

[56] References Cited

U.S. PATENT DOCUMENTS

| | | | |
|---|---|---|---|
| 2,542,074 | 2/1951 | Bierman | 272/57 |
| 4,229,001 | 10/1980 | Roman | 272/96 |
| 4,229,002 | 10/1980 | Masters | 482/44 |
| 4,247,098 | 1/1981 | Brentham | 272/130 |
| 4,371,161 | 2/1983 | Williams | 272/96 |
| 4,577,861 | 3/1986 | Bangerter et al. | 482/100 |
| 4,930,767 | 5/1990 | Hamm | 272/96 |
| 5,013,037 | 5/1991 | Stermer | 272/139 |
| 5,074,549 | 12/1991 | Harvey | 128/25 B |

*Primary Examiner*—Stephen R. Crow
*Attorney, Agent, or Firm*—Michael A. Mann

[57] ABSTRACT

An apparatus for exercising muscles of the leg comprising a frame, a padded sling for engaging the back of the knee, a load and a cable running from the load to the sling over one or more pulleys hung from the frame so that the load loading is applied perpendicularly to the back of the knee as it is straightened. A foot rest aligned with the sling assures that the foot remains planted throughout the movement of the leg except for flexing at the ankle. At least one of the pulleys is adjustable so that legs of different length can be accommodated. The type of load includes weights, an hydraulic cylinder, extension or compression springs and isokinetic mechanisms.

16 Claims, 2 Drawing Sheets

LEG EXERCISE APPARATUS AND METHOD

BACKGROUND OF THE INVENTION

1. Field of the Invention

The present invention relates to exercise equipment. In particular, the present invention relates to equipment for therapeutic exercise of leg muscles.

2. Discussion of Background

There has been a rapid growth in the number and types of exercise equipment in the recent past, paralleling interest in exercise generally. Exercise is also an important part of therapy, following an injury or illness. The leg muscles are large muscles and an especially important muscle group. Working the leg muscles is usually key to exercising aerobically as well as to standing and walking.

A number of devices exist that exercise muscles of the upper leg: the quadriceps, the hamstrings and the gluteal muscles. See for example the leg exercising device of Brentham in U.S. Pat. No. 4,247,098 which requires a user to lift the thigh against a resistance load provided by an hydraulic cylinder. A much different device is disclosed by Roman in U.S. Pat. No. 4,229,001. Roman's therapeutic exerciser for the leg is a boot-like device mounted on a pair of rails. The device is useful for knee bending exercises in which the boot is moved from a leg-bent position to a leg-straightened position against a resistance provided by springs in the rails.

The device of Bierman, described in U.S. Pat. No. 2,542,074, comprises a frame with a load attached via a cable and pulleys to a pivotable foot rest. Movement of the foot in exercising the lower leg muscles is against the load.

None of these devices, however, exercises the muscles of the leg by applying a load directly to the posterior aspect of the knee.

SUMMARY OF THE INVENTION

According to its major aspects and broadly stated, the present invention is an apparatus for exercising muscles of a user's leg by applying a load to the back of the knee when the knee is moved to a straightened from a bent position. The apparatus comprises a frame, means for engaging the posterior aspect of the user's knee, means for resisting but not preventing movement of the engaging means by muscles of the leg between a first, bent position and a second, straightened position, and a pivotable foot rest. The resisting means does not apply a resistance when the knee is bent but, as the knee is straightened, resistance to that movement, but not enough resistance to prevent movement, is applied by a load, such as weights, extension or compression springs or hydraulic cylinders.

The resistance of the load is applied, preferably isokinetically, so that changes in speed are prevented, to the posterior aspect of the knee at a position between the distal end of the femur and the proximal end of the tibia using, in one embodiment, a compression spring with a pad positioned behind the knee, or, in another embodiment, a load attached to a padded sling via a cable and one or more pulleys. The number of pulleys depends on whether the user is standing, sitting or lying prone. Preferably, both the cable and the pulleys are adjustable so that legs of different lengths can be accommodated by the same apparatus and still apply the load approximately perpendicularly to the knee.

Applying the load to the posterior aspect of the knee as the knee is straightened and the foot is "planted" is an important feature of the present invention. This feature simulates the duty of the leg muscles in walking, especially up an incline or stairs, and thus better prepares a leg undergoing therapy for normal use. In walking, the trailing foot is planted on a surface and the knee is straightened to propel the body forward. The load is applied in walking not when the knee is bent but in straightening it. Although the foot is planted, that is, its horizontal movement is prevented by friction with the surface, the ankle flexes as the lower leg rotates slightly with respect to the foot. This movement, including the planting of the foot and the flexing of the ankle, is reproduced by the present invention.

Another important feature of the present invention is the use of a padded sling and a movable pulley. The advantage of this feature is that legs of different length can be easily and comfortably accommodated when placed in the sling but the load will still be applied from a direction perpendicular to the leg, that is, directly above the knee.

Another feature of the present invention is the adaptability of the present invention to users in different physical orientations. The apparatus can be used horizontally by a user sitting, lying, standing or prone.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
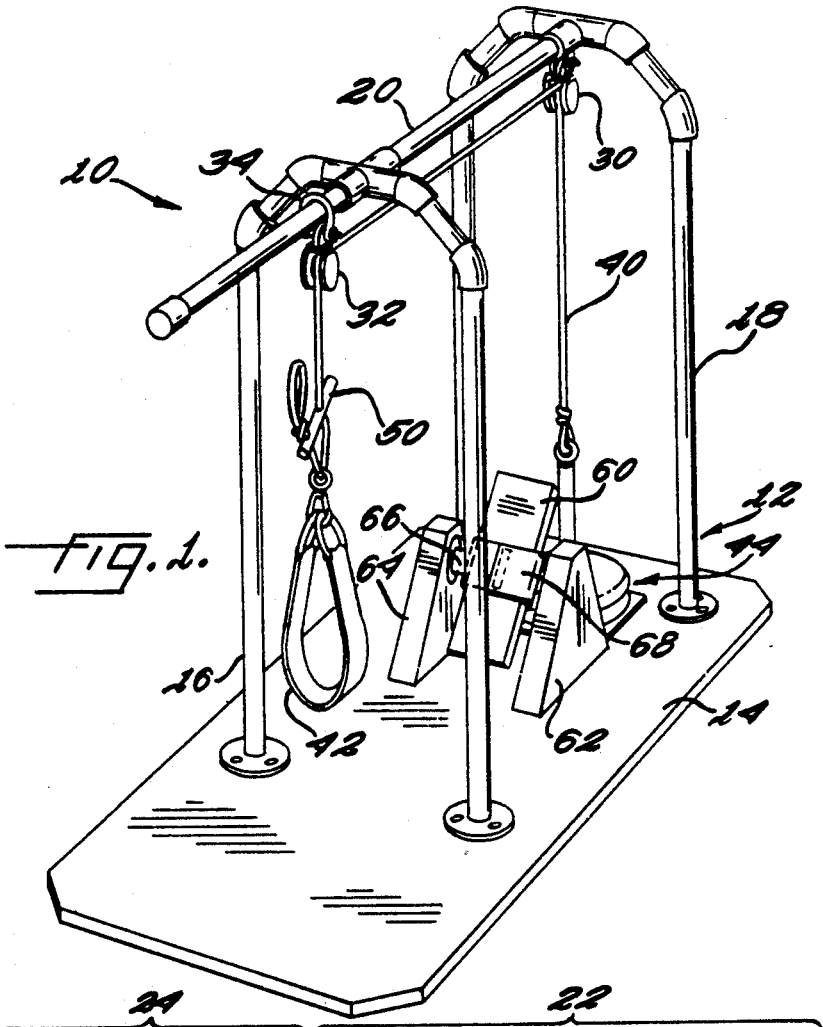
FIG. 1 is a perspective view of an apparatus according to a preferred embodiment of the present invention.
Figure 2:
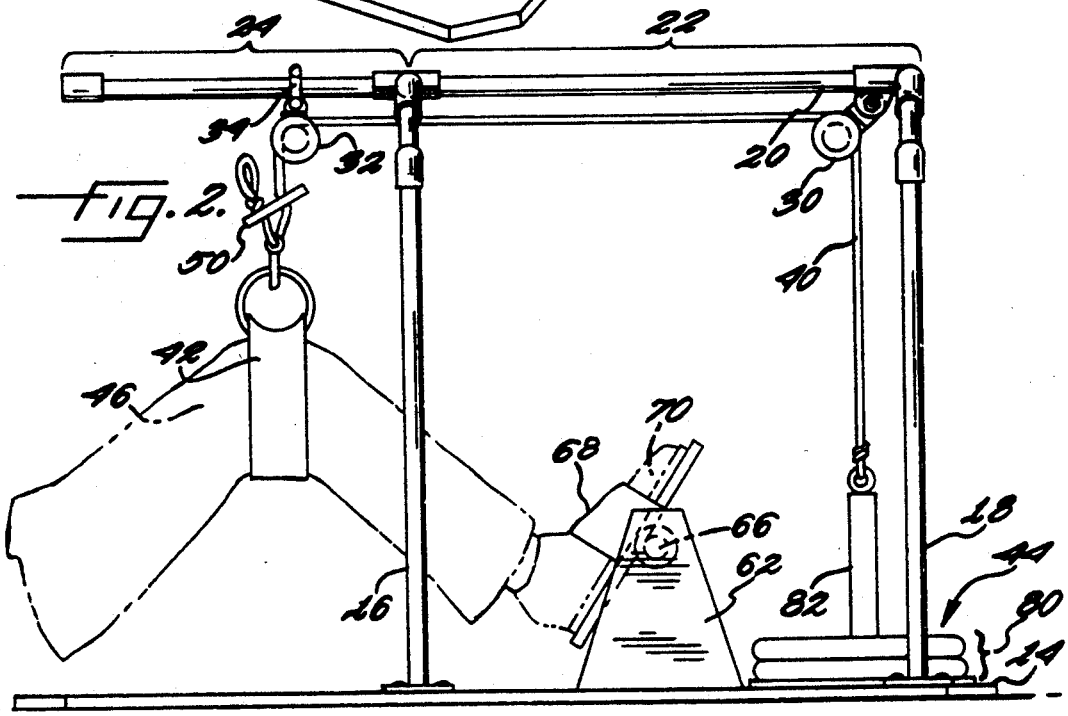
FIG. 2 is a side view of the apparatus of FIG. 1.

Referring now to FIGS. 1 and 2, there is illustrated an apparatus 10 according to the present invention for use in exercising muscles of a leg by a seated or lying user. Apparatus 10 has a frame 12 with a base 14, a front vertical support 16, a rear vertical support 18 and a horizontal support 20. Front and rear vertical support 16, 18 stand upwardly from base 14 and are separated by and secured in position by horizontal support 20. Horizontal support 20 has a first portion 22 between front and rear vertical supports 16, 18, and a second portion 24 between front vertical support 16 and its free end (FIG. 2).

Two pulleys are hung from horizontal support. There is a first, stationary pulley 30 and a second, movable pulley 32. Second pulley 32 is movably hung from horizontal support 20 by a ring 34, or alternatively an adjustable collar, along second portion 24.

A cable 40 runs between first and second pulleys 30, 32 and terminates at one end in a padded sling 42 and at the other end in a load 44. Moving padded sling 42 downwardly, toward base 14, pulls cable 40 and raises load 44. Load 44 resists, but does not prevent, movement in accordance with the amount and nature of the load.

Sling 42 is dimensioned to be placed around the back of the knee of the user, engaging the posterior aspect of a knee 46 between the distal end of the femur and the proximal end of the tibia (FIG. 2). Second pulley 32 is movable so that legs of different length can be accommodated by positioning second pulley 32 directly above the user's knee 46. In this position the load will be applied perpendicularly to knee 46, that is, load 44 will apply tension to cable 40 in a direction upwardly from knee 46.

Preferably sling 42 will include some means for adjusting the length of cable 40, such as use of a member 50 having a pair of throughholes for threading excess cable therethrough so that, when knee 46 is in sling 42 and load 44 is applied, member 50 is turned at an angle to lock cable. Member 50 provides a convenient means for adjusting the length of cable 44, however, clamps or other well-known devices for securing excess cable could also be used.

Also attached to frame 12 at base 14 is a foot rest 60 having two brackets 62, 64 and a pivot pin 66 therebetween. A strap 68 attached to foot rest 60 is used to secure a foot 70 of the user. Foot rest 60 is aligned with padded sling 42 and assures that foot 70 remains planted during movement of the user's leg except for flexing at the ankle.

Figure 4:
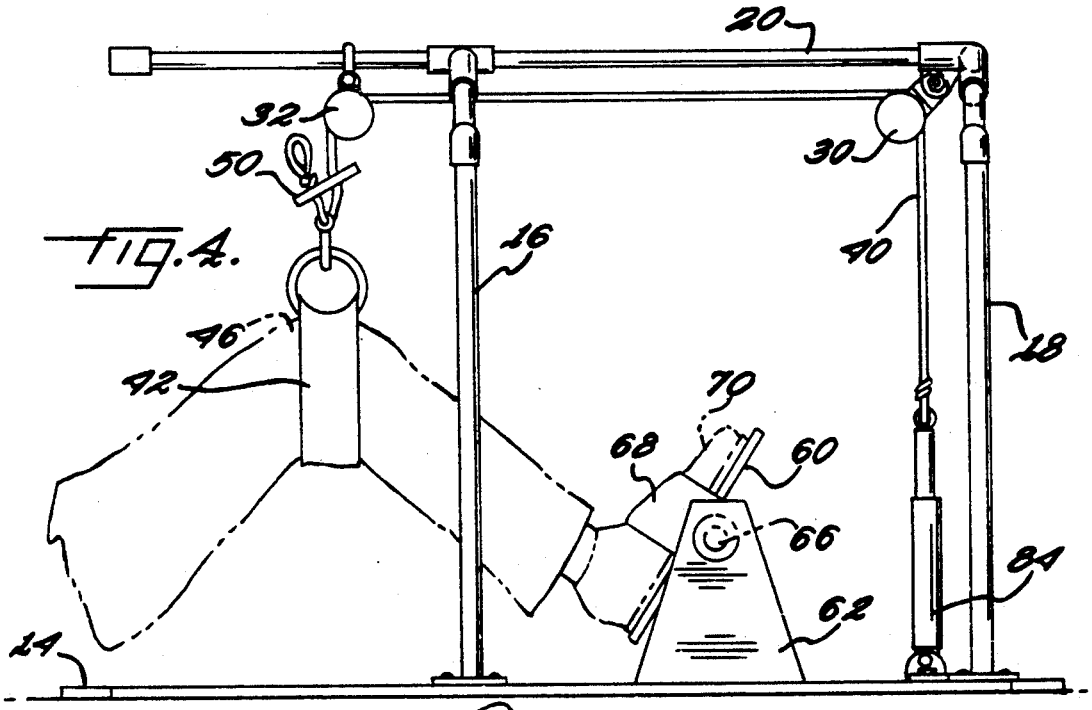
FIG. 4 is a side view of a second alternative embodiment of an apparatus according to the present invention.

Load 44 is shown in FIGS. 1 and 2 as stack 80 of weights on a carrier 82 to which cable 40 is attached. Other forms of loads, as are well known, are possible, including an hydraulic cylinder 84, as illustrated in FIG. 4, or an extension spring (not shown) attached to base 14 and cable 40 and stretched by the downward movement of sling 42. Alternatively, a weight that is rotated against a biasing spring (not shown) with an changing radius as is used in NAUTILUS exercise equipment can be used to alter the amount of load as a function of the elevation of sling 42.

Preferably, load 44 is applied isokinetically, that is, it is applied in such a way that the speed at which sling 42 is lowered is kept constant regardless of the force exerted. Isokinetic loading of muscles is well known in exercise equipment, such as that produced under the trademark CYBEX.

Figure 3:
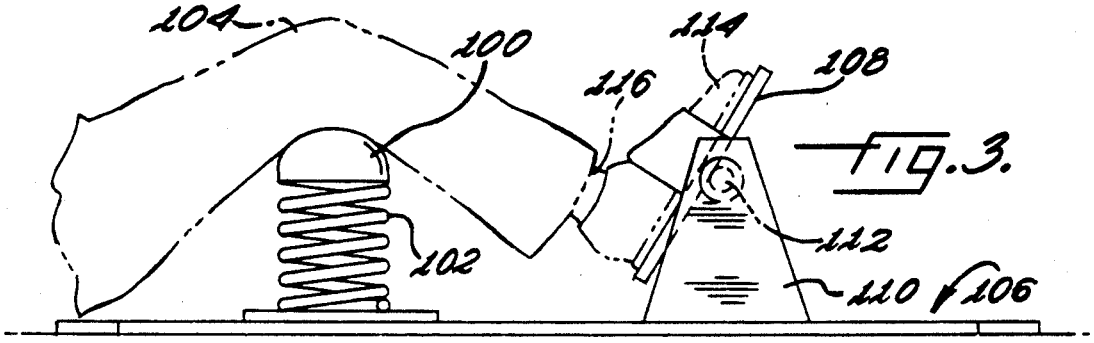
FIG. 3 is a side view of a first alternative embodiment of an apparatus according to the present invention.

An alternative embodiment of the present invention is illustrated in FIG. 3, wherein a pad 100 supported by a compression spring 102 is used to apply a load directly to the posterior aspect of a knee 104. Spring 102 is attached to a frame 106. A foot rest 108 pivotably supported by a bracket 110 and pivot pin 112 holds a user's foot 114 and allows the ankle 116 of foot 114 to rotate slightly.

Figure 5:
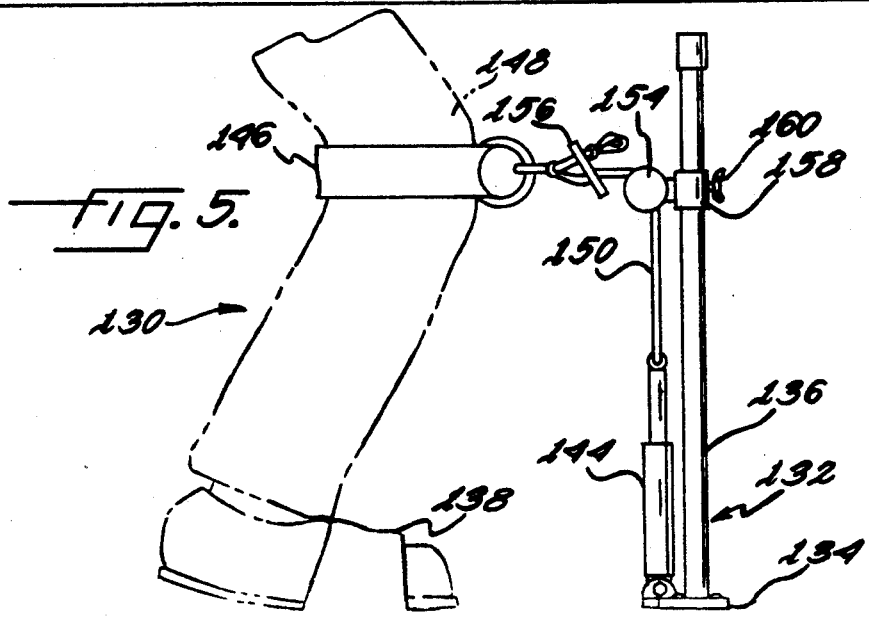
FIG. 5 is a side view of a third alternative embodiment of an apparatus according to the present invention.

In still another embodiment shown in FIG. 5, an apparatus 130 according to the present invention is for use in exercising muscles of a leg by a standing user. Frame 132 has a base 134 and a vertical support 136 secured to base 134. A foot insert 138 is attached to base 134 to stabilize the foot by holding the toes and ball of the foot while allowing the heel to be raised as the knee bends. Also attached to base 134 is an hydraulic cylinder 144 serving as a load. A padded sling 146 runs behind knee 148 and is attached to cylinder 144 by a cable 150. A pulley 154 changes the direction of cable so that load is applied perpendicularly to knee through sling 146.

Both the length of cable 150 is adjustable by a member 156 as previously described, and the height of pulley 154 is adjustable in the vertical direction along vertical support 136 using a collar 158 and nut 160, preferably hand-tightenable.

In use, a user puts his or her leg through sling 42 (FIG. 1) positioning sling 42 behind knee 46 in a bent position and plants foot 70 on foot rest 60, adjusting movable pulley 32 so that cable 40 applies load 44 perpendicularly to the user's leg, and then secures foot 70 with strap 68. User then uses his or her quadriceps femoris, sartorius, ham strings and gluteus maximus against load 44 to move the leg to a straightened position.

Apparatus 10 is especially appropriate for therapeutic use following a leg injury but may also be used in promoting fitness generally. Apparatus 10, and the equivalent variations of it, comprises a closed kinetic chain, because the foot is stabilized, as is necessary for more functional weight bearing activities such as walking, particularly up an incline or stairs. Thus apparatus 10 simulates these activities better because the foot of a bent knee is planted and then the muscles of the leg straighten the leg to move the body.

It will be apparent to those skilled in the art that many changes and substitutions can be made to the preferred embodiment herein described, such as adapting apparatus 10 for use by both legs simultaneously or alternatingly, an arrangement especially well suited when the load is an air cylinder, without departing from the spirit and scope of the present invention as defined by the appended claims.

What is claimed is:

1. An apparatus for exercising muscles of a user's leg, said apparatus comprising:

a frame;

means for engaging the posterior aspect of the knee of said leg, said engaging means carried by said frame, said engaging means is a sling, said sling adapted to be positioned against the posterior aspect of said knee;

means for resisting but not preventing movement of said engaging means by muscles of said leg, said resisting means carried by said frame and in operative connection with said engaging means, said resisting means having a first position and a second position, said resisting means being in said first position when said leg is bent at the knee and in said second position when said leg is straightened, said resisting means applying no resistance when in said first position and applying resistance when in said second position, so that resistance is applied when straightening said leg; and a foot rest pivotally attached to said frame and spaced apart from said engaging means.

2. The apparatus as recited in claim 1, wherein said engaging means includes a pad, said pad adapted to be positioned against the posterior aspect of said knee.

3. The apparatus as recited in claim 1, wherein said resisting means further comprises:

a load having a resistance to movement; and means for applying said resistance of said load to said engaging means, said applying means carried by said frame.

4. The apparatus as recited in claim 1, wherein said resisting means further comprises:

a load having a resistance to movement;

a cable attached to said load; and pulley means for applying said resistance of said load approximately perpendicularly to said leg.

5. The apparatus as recited in claim 1, wherein said resisting means further comprises:

a load having a resistance to movement;

a cable attached to said load; and at least one pulley for applying said resistance of said load to said leg, said pulley being carried by said frame and having means for changing the position of said pulley to accommodate legs of different length and apply said resistance approximately perpendicularly to said leg.

6. The apparatus as recited in claim 1, wherein said resisting means further comprises:

an hydraulic cylinder having a resistance;

a cable attached to said cylinder; and pulley means for applying said resistance of said hydraulic cylinder approximately perpendicularly to said leg.

7. The apparatus as recited in claim 1, wherein said resisting means further comprises:

an extension spring having a tension;

a cable attached to said extension spring; and pulley means for applying said tension of said extension spring approximately perpendicularly to said leg.

8. The apparatus as recited in claim 1, wherein said resisting means further comprises a compression spring positioned behind said knee.

9. The apparatus as recited in claim 1, wherein said resisting means resists movement isokinetically.

10. An apparatus for exercising muscles of a user's leg, said apparatus comprising:

a frame;

a pad carried by said frame and dimensioned for engaging the posterior aspect of said user's knee, said pad includes a sling, said sling adapted to be positioned against the posterior aspect of said knee;

a load carried by said frame;

a pivotable foot rest carried by said frame, said foot rest in spaced relation to said load; and means for connecting said load to said pad so that said pad has a first position and a second position, said leg bent at the knee when said pad is in said first position and said leg straightened when said pad is in said second position, said connecting means applying said load when said pad is moved from said first position to said second position.

11. The apparatus as recited in claim 10, wherein said connecting means further comprises at least one pulley and a cable, said cable running from said load to said pad, said at least one pulley changing the direction of said cable so that said load is applied approximately perpendicularly to said leg when said knee is straightened.

12. The apparatus as recited in claim 10, wherein said connecting means further comprises at least one pulley and a cable, said cable running from said load to said pad, said at least one pulley changing the direction of said cable so that said load is applied approximately perpendicularly to said leg when said knee is straightened, said at least one pulley being movable so that legs of different sizes can be accommodated.

13. The apparatus as recited in claim 10, wherein said connecting means further comprises at least one pulley and a cable, said cable running from said load to said pad, said at least one pulley changing the direction of said cable so that said load is applied approximately perpendicularly to said leg when said knee is straightened, the length of said cable being adjustable so that legs of different sizes can be accommodated.

14. The apparatus as recited in claim 10, wherein said connecting means further comprises at least one pulley and a cable, said cable running from said load to said pad, said at least one pulley changing the direction of said cable so that said load is applied approximately perpendicularly to said leg when said knee is straightened, said at least one pulley being movable and the length of said cable being adjustable so that legs of different sizes can be accommodated.

15. The apparatus as recited in claim 10, wherein said load is an hydraulic cylinder.

16. The apparatus as recited in claim 10, wherein said load is applied isokinetically.

* * * * *